US006628795B1

(12) United States Patent
Ludvigsen

(10) Patent No.: US 6,628,795 B1
(45) Date of Patent: Sep. 30, 2003

(54) DYNAMIC AUTOMATIC GAIN CONTROL IN A HEARING AID

(75) Inventor: Carl Ludvigsen, Valby (DK)

(73) Assignee: Widex A/S, Vaerloese (DK)

( * ) Notice: Subject to any disclaimer, the term of this patent is extended or adjusted under 35 U.S.C. 154(b) by 0 days.

(21) Appl. No.: 09/581,636

(22) PCT Filed: Dec. 23, 1997

(86) PCT No.: PCT/DK97/00598

§ 371 (c)(1),
(2), (4) Date: Oct. 16, 2000

(87) PCT Pub. No.: WO99/34642

PCT Pub. Date: Jul. 8, 1999

(51) Int. Cl.[7] ..... H04R 25/00
(52) U.S. Cl. ..... 381/321; 381/107
(58) Field of Search ..... 381/102, 104, 381/106, 107, 108, 321, 312, 313, 314, 316, 317, 318; 330/134

(56) References Cited

U.S. PATENT DOCUMENTS

| | | | | |
|---|---|---|---|---|
| 4,204,260 A | | 5/1980 | Nysen | |
| 4,531,229 A | | 7/1985 | Coulter | |
| 4,718,099 A | | 1/1988 | Hotvet | |
| 4,996,712 A | * | 2/1991 | Laurence et al. | 381/320 |
| 5,144,675 A | | 9/1992 | Killion et al. | |
| 5,165,017 A | | 11/1992 | Eddington et al. | |
| 5,402,498 A | | 3/1995 | Waller, Jr. | |
| 5,687,241 A | | 11/1997 | Ludvigsen | |
| 5,903,655 A | * | 5/1999 | Salmi et al. | 381/321 |

FOREIGN PATENT DOCUMENTS

| | | |
|---|---|---|
| DE | 42 28 934 A1 | 1/1993 |
| EP | 0 732 036 B1 | 5/1997 |
| GB | 2 192 511 A | 1/1988 |
| WO | WO 96/35314 | 11/1996 |
| WO | WO 97/11572 | 3/1997 |

OTHER PUBLICATIONS

"A Comparison of Four Methods of Implementing Automatic Gain Control (AGC) in Hearing Aids", by Moore, et al., British Journal of Audiology, 1988.

"Appareils de correction auditive" (Hearing aids Part 2: Hearing Aids with automatic gain control circuits); Commission Electrotechnique Internationale Norme De La Cei, 1983.

"A Comparison of Four Methods of Implementing Automatic Gain Control (AGC) in Hearing Aids", by B. Moore, et al., British Journal of Audiology, 1988, No. 22, pp. 93–104.

* cited by examiner

*Primary Examiner*—Curtis Kuntz
*Assistant Examiner*—B Ensey
(74) *Attorney, Agent, or Firm*—Sughrue Mion, PLLC

(57) ABSTRACT

Automatic gain control in a hearing aid is effected by detecting an input sound level and/or an output sound level and adapting the output sound level supplied by the hearing aid in response to the detected sound level by controlling the gain of the hearing aid towards an actual desired value of the output sound level. The gain control is effected at increases and decreases, respectively, of the input sound level by adjusting the gain towards the actual desired value with an attack time and a release time, respectively, which are adjusted in response to the detected sound level to a relatively short duration providing fast gain adjustment at high input and/or output sound levels and to a relatively long duration providing slow gain adjustment at low input and/or output sound levels.

24 Claims, 6 Drawing Sheets

DYNAMIC AUTOMATIC GAIN CONTROL IN A HEARING AID

BACKGROUND OF THE INVENTION

The invention relates to a method for automatic, gain control in a hearing aid comprising at least one input signal transducer, a signal processor including at least one processing channel and an output signal transducer, said method comprising the steps of detecting an input signal from said input signal transducer and/or an output signal from said signal processor and adapting, within an operational range of said automatic gain control, said output sound level supplied by said output signal transducer in response to said detected sound level by controlling the gain of said signal processor towards an actual desired value of said output sound level, said gain control being effected at increases and decreases, respectively, of said input sound level by adjusting the gain towards said actual desired value with an attack time and a release time, respectively, whereby said release-time is variable in response to changes in said received sound level.

In FIG. 1 of the accompanying drawings, the dashed line 1 illustrates the sound volume perception of a person having normal hearing as a function of the sound level received by the ear in the form of a straight line indicating sound perception with the same volume as the received sound.

The solid curve 2 illustrates a typical example of the sound volume perception for a person having a hearing impairment. The hearing loss is dependant of the sound level and, normally also of frequency. With the illustrated hearing impairment, the perception of sounds below a certain level K4 is significantly reduced and at a threshold level K3 the sound disappears completely.

For sound levels above the threshold level K4, the sound perception approaches normal hearing with a certain damping.

Complete compensation of a hearing impairment as illustrated by the curve 2, to make the sound perception of the hearing impaired person equal to that of a normal hearing person, would in theory require a transfer function from the sound received at the ear to the sound perceived by the ear as illustrated by the dotted curve 3. A theoretical compensation of this kind would not be desirable in practice, however, since amplification of sound would be effected also in quiet sound environments having a low sound intensity without any real sound information, in which amplified sound would be perceived as noise. Such a theoretical compensation would further require a hearing aid having a very high gain and a low noise.

Therefore, compensation of a hearing impairment as illustrated by the curve 2 has been implemented in practice by means of hearing aids having a constant gain up to a cut-off limit as illustrated by the dashed curve 4, or hearing aids having a compressor characteristic as illustrated by the curve 5, or a variable characteristic as exemplified by the solid curve 6 composed of straight line segments with knee points at sound levels K2, K4 and K5.

A linear, constant gain characteristic as illustrated by the curve 4 provides a natural sound perception, when the gain is adjusted to the actual listening situation or sound environment, but would require continuously repeated adjustment of the gain to the actual situation, whereby operation of the hearing aid will become complicated and cumbersome. As a result, hearing aids of this type are frequently not adjusted to an optimum sound perception for the actual listening situation.

Attempts to remedy this disadvantage have involved the use of hearing aids having automatic gain control, e.g., as exemplified by the compressor characteristic illustrated by the curve 5. Whereas such a linear continuous characteristic provides for automatic adaptation to different sound environments and an improved sound perception, in particular at low sound levels, the performance does not provide an ideal approximation to the actual hearing loss as illustrated by the curve 2, but provides only a higher amplification of low sound levels. Since very low sound levels frequently contain noise only, the high amplification may cause a serious discomfort.

An improved hearing loss compensation can be obtained with a variable gain characteristic, e.g., as illustrated by the curve 6 in FIG. 1. This transfer function provides an expansion characteristic at low sound levels with maximum amplification of the received sound level at the knee point K2, whereby sound levels below this knee point are damped with increasing attenuation for decreasing level of the received sound. In the range from knee point K2 through the knee point K3, which represent the threshold for the hearing loss, up to the knee point K4, a compressor characteristic is provided causing decreasing amplification of received sound levels above knee point K2 up to knee point K4, thereby providing a compensation counteracting the hearing loss in this range, which is at the same time a critical range, within which silent speech or other sound may cause problems to hearing impaired persons, who will therefore benefit from this type of compensation approaching an ideal compensation. Above the knee point K4 up to a knee point K5, which represents a pain or discomfort limit, the transfer function will provide a substantially constant gain to provide compensation for the reduction-in sound perception in this range. Above the knee point K5 a compressor characteristic is provided, which may either be determined by the transfer function or result from clipping in the amplifier circuit. Beyond the knee point K5 the sound reproduction will often be selected to prevent Hounds beyond the pain or discomfort limit to reach the ear.

If transfer functions with variable gain as illustrated by curves 5 and 6 in FIG. 1 act momentarily to provide a momentarily implemented nonlinear transfer function, sound will be heavily distorted, and the sound reaching the ear will become unnatural and uncomfortable. As an example, with a transfer function as shown by the curve 5, a sine-wave tone will be changed towards a square wave signal.

This distortion may be avoided and a more natural sound reproduction like the one obtainable with constant linear gain may be obtained by use of automatic gain control (AGC) with a quasi-linear amplification by which the gain will be continuously adapted to the actual received sound level with a smooth adjustment. The adaptation is effected with time delays which according to IEC Standard No. 118-2 from 1983 are defined as an attack time and a release or recovery time.

In this standard, the attack time is defined as the time interval from a sudden increase of the input signal level by a predetermined amount in dB until stabilization of the output level from the hearing aid with AGC within +/−2 dB from the amplified steady-state output level.

The release or recovery time is defined in the above-mentioned IEC standard as the time interval from a sudden decrease of the input signal level by a certain amount in dB until stabilization of the output signal level within +/−2 dB from the lower steady-state output level.

In the following description of the invention, the terms "attack time" and release time" are used primarily as synonyms for the equivalent slope rates measured in dB/sec.

In practice, this form of AGC is implemented by detection of the received sound level or the output sound level and use of this detection to effect a smooth adjustment of the gain with the time delay, attack or release time, to the value desired for the actually detected sound level. The adjustment is effected by means of a compressor function as illustrated by the curve 5 in FIG. 1. In case of an increase of the received sound level compared to what has been earlier detected, gain adjustment is effected with an attack time, and in case of a decrease of the received sound level gain adjustment is effected with a release or recovery time. In practice, the time delays are selected to provide a short attack time to prevent the user from receiving uncomfortably high sound levels and a long release time to prevent pulsation or pumping of the sound level from reaching the ear. However, in case of a compressor function, a release time of long duration for increasing the gain at a decrease in the detected received sound level, has the disadvantage that when the user is exposed to a high sound level caused e.g. by the user shouting at a person situated remotely or a door is slammed nearby, the user will be unable to hear low sound levels during a period thereafter.

In conventional hearing aids it is necessary to compromise between reception of an optimum amount of information with ;short adjustment times and avoidance of up/down pumping by using long adjustment times. As a result, prior art designs exhibit a smaller or larger tendency to suppress information and/or allow up/down pumping in some listening situations.

Numerous attempts have therefore been made to distinguish between received sounds and adjust for a decreasing detected input sound level by means of varying release times, in order that a high gain can be reinstated quickly following a short heavy sound pressure.

In connection with these efforts, the parameter or parameters of the input signal that are measured or detected to determine the detected sound level, are important. In simple designs these parameters may comprise peak value, average value, effective value or the like.

A peak value detector produces a signal dependant on the peak values of the detected signal and provides a fast adjustment or short attack time at increasing received peak values, but a considerably slower adjustment or a relatively long release time at decreasing received peak values. Use of a peak value detecting circuit in conventional hearing aids having a transfer function as illustrated, e.g., by the curve 5 in FIG. 1 provides the advantage of a quick damping of short heavy received sound levels in the form of noise pulses, but also the accompanying disadvantage that in case of speech signals containing high peak values spaced in time the gain will quickly be adjusted towards the peak values of the speech, whereby the speech is smoothed on the basis of the peak values and will attain the same level as received in speech pauses during which the sound is frequently noise.

Average or effective value detectors provide in general a less quick adjustment at suddenly increasing detected values, but compared to peak value detectors they show a smaller tendency to suppress speech signals or suppress the sound reproduced after very short heavy received sound levels.

In practice, use is frequently made of combined circuits to determine or distinguish between received sounds. Such circuits provide short attack time at increasing input level and acts like a peak value detector, whereas at stationary or decreasing input level they have a relatively longer release time and acts frequently as an average value detector.

A suitable alternative to conventional detectors are so called percentile detectors as known, e.g., from EP-B1-0 732 036. Generally such percentile detectors serve to determine the value of the detected signal, at which predetermined percentages or percentiles of the detected signal are below or above the selected value, respectively. Such detectors are well suited to determine and separate noise from information signals.

In a hearing aid AGC circuit known from U.S. Pat. No. 5,165,017, as a solution to the disadvantage of a long release time by detection using a peak value detector to provide for the peak value detector a short release time after heavy received sound levels and a long release time after relatively weak received sound levels.

For hearing aid detectors it is further known, e.g. from U.S. Pat. Nos. 4,531,229 and 5,144,675, to combine a peak value detecting circuit providing adjustment with short time delays and an average value detecting circuit providing adjustment with long time delays, whereby the average value detecting circuit can measure the average value of peaks. By this form of adjustment, short heavy sound levels will quickly excite the peak value detecting circuit and provide a quick gain reduction. After the heavy sound level the peak value detecting circuit will provide a fast readjustment of the gain to an amount corresponding to the actually received sound level or an amount, at which the average value detecting circuit takes over the gain adjustment, and at repeated short pulses there will be a pronounced pumping effect. At heavy sound levels of a longer duration the average value detector is excited and takes over the gain adjustment, After disappearance of the heavy sound pressure of longer duration following the taking over by the average value detector, the gain is adjusted slowly as a function of the decreasing mean value and during a time interval thereafter there will be an insufficient amplification of weak signals.

In multiple channel hearing aids, it is known to use separate AGC controls in the individual processing channels, each having attack and release times adapted to the specific frequency band of the channel, such as described e.g. by Brian C. J. More and Brian R. Glasberg in "A comparison of four methods of implementing automatic gain control (AGC) in hearing aids", British Journal of Audiology, 1988, volume 22, pages 93 to 104.

Thus, to compromise between minimization or a pumping or vibrating sound effect of the reproduced sound and avoidance of insufficient amplification of weak sound following heavy received sound levels, it has become known in the art to use a short attack time and different release times.

SUMMARY OF THE INVENTION

Against this background, it is the object of the invention to provide a method for improving the sound reproduction in a hearing aid and minimize the disadvantages of known AGC methods.

According to the invention, this object is attained by a method as defined hereinbefore, which is in that said attack and release times are adjusted in response to said detected sound level to a relatively short duration providing fast gain adjustment at high input and/or output sound levels and to a relatively long duration providing slow gain adjustment at low input and/or output sound levels.

By this method, the sound will be controlled with long attack and release times at low sound levels, at which the transfer function provides a compressor characteristic and the reproduced sound is very sensitive to pumping or vibrating sound effects when the gain varies with time. On the other hand, at heavy sound levels at which the reproduced sound approaches the clipping or pain threshold, the sound is controlled with short attack and release times.

Thereby, in addition to the advantages obtained by varying release times, the method according to the invention provides the advantage that at a weak received sound change, which is heavier than the earlier detected sound change, there will be no immediate change of gain, as with a short attack time, but a gradual gain change with a relatively long time constant, whereby a short increase of sound will not lead to any significant gain change. Even if the long attack time entails that sound increases at a low level will be reproduced more heavily during a time period after their generation than they ought to be according to the compression characteristic, this will in practice have the advantageous effect that the sound will not immediately change character due to a gain change in the range within which the received sound will be perceived as relatively weak both by a hearing impaired person and a person not having any hearing loss.

Preferred and advantageous implementations of the method are reflected in various of the claims appended hereto.

For carrying out the method the invention relates, moreover, to a hearing aid of the kind comprising at least one input signal transducer, a signal processor including at least one processing channel with associated gain control means and an output signal transducer, said hearing aid further comprising detecting means for detecting an input signal from said input signal transducer and/or an output signal from said output signal transducer and controlling said automatic gain control means in response to said detected sound level to adapt, within an operational range of said automatic gain control, the gain of said signal processor towards an actual desired value of said output sound level, said automatic gain control means including adjusting means to effect said gain control, at increases and decreases, respectively, of said input sound level, by adjustment of the gain towards said actual desired value with an attack time and a release time, respectively, where said release time is variable in response to changes in said input signal level.

According to the invention, such a hearing aid is characterized in that said adjusting means is connected to said detecting means to receive a control signal therefrom to adjust said attack and release times in response to said detected sound level to a relatively short duration providing fast gain adjustment at high input and/or output sound levels and to a relatively long duration providing slow gain adjustment at low input/ and/or output sound levels.

Preferred and advantageous embodiments of this hearing aid are reflected in various of the claims appended hereto.

BRIEF DESCRIPTION OF THE DRAWINGS

In the following, the invention will be further explained with reference to the accompanying drawings, in which FIG. 1, as already explained, shows graphic representations of sound level perceptions including hearing loss and compensation characteristics as functions of the detected received sound level.

DETAILED DESCRIPTION OF THE INVENTION

Figure 2:
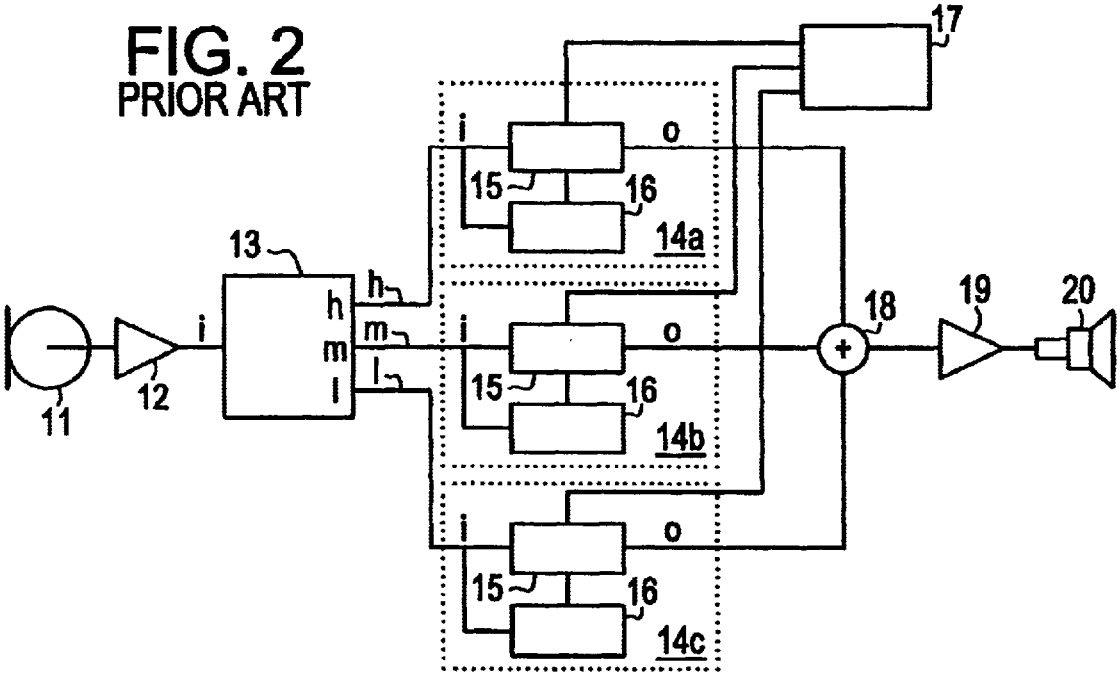
FIG. 2 PRIOR ART
FIG. 2 shows an example of a conventional hearing aid having three processing channels with individual sound level detecting means and feed-forward AGC control means.

FIG. 2 shows a schematic block diagram of a 3-channel hearing aid comprising a microphone 11 and a preamplifier 12 followed by a band-split filter 13 to separate input signals as received from the preamplifier 12 between three signal processing channels 14*a*, 14*b* and 14*c* each comprising a signal processor 15 and a sound level detection circuit 16 for detection of the received sound level as represented by the input signal to the actual processing channel. The hearing aid further comprises a memory 17 for storing processing parameters for the hearing aid, a summation circuit 18 to sum up the output signals supplied from the signal processors 15 in the three processing channels 14*a–c* to an overall output signal, which is supplied via an output amplifier 19 to an output transducer in the form of a telephone 20.

In each signal processing channel 14*a–c*, the microphone signal received from the preamplifier 12 via the band-split filter 13 is further supplied to the detection circuit 16, which controls the amplification in the signal processor 15 by automatic gain control, AGC.

The detection circuit 16 may thus, in response to a processed microphone signal, provide a gain adjustment signal representing a detected sound level. This gain adjustment signal is supplied to a control input 15*c* of the signal processor 15, in which the gain adjustment signal is used as input for a compensation function which may, e.g., be of the kind illustrated by the curve 6 in FIG. 1, whereby the gain of signal processor 15 is adjusted automatically towards the gain prescribed by the transfer function, e.g., as exemplified by the curve 6 in FIG. 1, in response to the adjustment signal received from the detection circuit 16.

Figure 3:
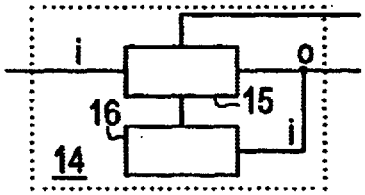
FIG. 3 shows a modification of the hearing aid in FIG. 2 with feed-back AGC control means.

In stead of a feed-forward arrangement as described above, the sound level detecting circuit 16 may advantageously be incorporated in a feed-back arrangement with the signal processor 15 including the AGC control as illustrated in FIG. 3 in order to avoid switch-over between short and long attack and release times being effected at varying output levels depending on gain.

As already mentioned, it is well known to us;e peak value detectors or average value detectors for the detection circuit 16.

Figure 4:
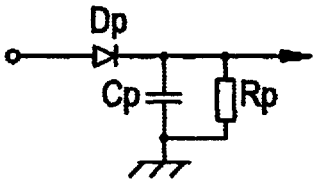
FIG. 4 PRIOR ART
FIGS. 4 to 7 show examples of prior art sound detecting circuits.

FIG. 4 shows an example of a peak value detector, in which the peak values of the incoming signal are measured by momentarily charging a capacitor Cp via a diode Dp, which provides for a short attack time. Following detection of the peak value, capacitor Cp is discharged through a resistor Rp, whereby the release time will be determined by Cp and Rp.

Figure 5:
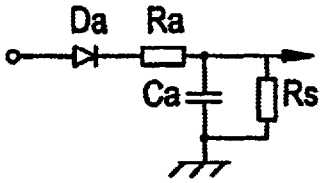
FIG. 5 PRIOR ART

FIG. 5 shows a detector circuit intermediate peak and average value detection. The capacitor Ca is charged via the diode Da and the resistor Ra and is discharged through the resistor Rs. In this circuit the attack time is determined by Ca and Ra and the release time by Ca and Rs. By appropriate selection of components this circuit may become predominantly a peak value detector or an average value detector.

Circuit configurations as shown in FIGS. 4 and 5 may individually be dimensioned with one attack and one release time only, as a result of which a compromise must be made between a pulsating or pumping sound reproduction and masking of subsequent weak received sound levels.

Figure 6:
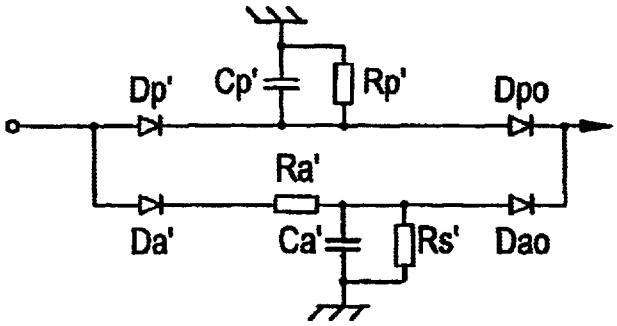
FIG. 6 PRIOR ART

In the detector circuit shown in FIG. 6, peak and average detection is combined involving the use of a quickly reacting peak detector circuit composed of capacitor Cp', resistor Rp' and diodes Dp' and Dpo to determine the attack time, whereas a circuit composed of capacitor Ca', resistors Ra' and Rs' and diodes Da' and Dao constitutes a more slowly reacting average detector, which will not influence the attack time. At a high sound level of short duration, capacitor Cp' will be charged, whereas due to the time constant provided by Ca' and Ra', capacitor Ca' will remain essentially uncharged. At disappearance of the short input signal, only Cp' will be discharged, which is effected quickly through resistor Rp', thereby providing a short release time. If the received high sound level is of long duration, capacitor Ca' will also be charged and, at subsequent disappearance of the longer input signal, both capacitors Cp' and Ca' must be discharged, which for capacitor Ca' is effected slowly through resistor Rs', thereby providing a long release time. Circuit configurations of this kind, by which the release time is switched between two fixed values depending on the duration of received high sound levels, have been disclosed in U.S. Pat. Nos. 4,531,229 and 4,718,099 and published British patent application GB-A-2,192,511.

Figure 7:
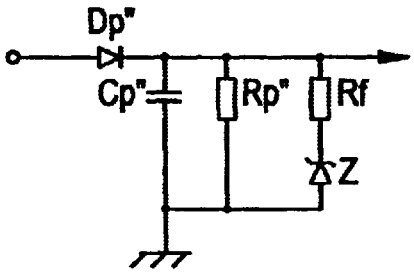
FIG. 7 PRIOR ART

FIG. 7 shows a modification of the peak value detector shown in FIG. 4, which provides for two distinct release time values, i.e. a relatively long release time providing for slow adjustment at low sound levels and a relatively short release time providing for fast adjustment at high sound levels. This is accomplished by addition of a series connection of a resistor Rf and a zener diode Z in parallel with resistor Rp", whereby capacitor Cp" will be discharged additionally through resistor Rf, when the voltage across Cp" is higher than the threshold voltage of zener diode Z. A circuit configuration of this kind switching the release time between two fixed values depending on the volume of the detected sound level has been disclosed in U.S. Pat. No. 5,165,017.

Thus, circuit configurations as shown in FIGS. 6 and 7 provide a release time of different duration according to the duration or volume of the received sound level. In many cases, this will provide for an improved perception of weak sound passages following high sound levels, but at the same time the short attack time entails that short sound peaks will immediately provide a gain decrease in connection with a compression function as illustrated e.g. by the curve 5 in FIG. 1, or in the range between knee points K2 and K4 of the curve 6 in FIG. 1. As a result, any sound pulse will in practice provide a gain decrease and the reproduced sound will vibrate or pump or subsequent weak sound levels will be insufficiently amplified.

By the method according to the invention, this disadvantage is overcome by sound level detection means providing attack and release times, which are determined by the detected sound level in such a way that at weak sound levels long attack and release times are used to provide for slow adjustment, whereas at high sound levels short attack and release times are used to provide for fast adjustment. In addition to the advantages obtainable by different release times, it is then avoided that the gain is adjusted too heavily at wean sound levels such as with a short attack time.

Thus, according to the invention, the attack and release times are relatively long at weak sound levels within the operative range of the automatic gain control, whereas they are relatively short at high sound levels.

As an example, a shift can be made between two attack and release times at a prescribed detected level. If at a certain low detected level the AGC has stabilized to provide maximum gain, which with a transfer function as illustrated by the curve 6 in FIG. 1 may be 30 dB at a detected sound level of 25 dB, and a higher sound pressure is detected, which is below the switch-over level for the attack and release times, the gain is adjusted slowly from the 30 dB value towards the gain prescribed by the transfer function for the detected sound level. If a long release time were active throughout the operative range, for the AGC, high level pulses could cause the amplifier to clip or limit at signal levels, where this should not take place when following the transfer function illustrated by the curve 6 in FIG. 1, as illustrated by the curve 7 showing the curve up to this unintentional clipping or limitation. In the illustrated example, maximum gain could be active within a range up to a sound reproduction of 110 dB for a detected input sound level of 80 dB, but in the range from 80 to 110 dB for the detected input sound level, a gain of more than 10 dB may cause unintentional clipping or limitation.

In practice, the change-over to short attack and release times is selected to a switch-over level, which is considerably lower than the clipping limit, e.g. 60 dB. Alternatively, the attack and release times may change in a plurality of steps or continuously, before the clipping limit is reached.

If, for instance, change-over is effected at a switch-over level corresponding to a detected sound level of 60 dB, all changes below that level will be effected with the long attack and release times. This may possibly entail that sound will not be amplified as prescribed by the transfer function, e.g. following the curve 6 in FIG. 1, but more importantly the reproduced sound will remain clear and natural without pumping effects.

If detection is performed of the output sound level employing a switch-over level corresponding to a detected level of 60 dB after the AGC circuit, the reproduced sound will not exceed 60 dB, until the short attack and release times take over.

If, on the other hand, the sound is detected prior to the AGC circuit with a switch-over level corresponding to a detected level of 60 dB, the reproduced sound may reach 75 to 90 dB, before the short attack and release times take over.

Figure 1:
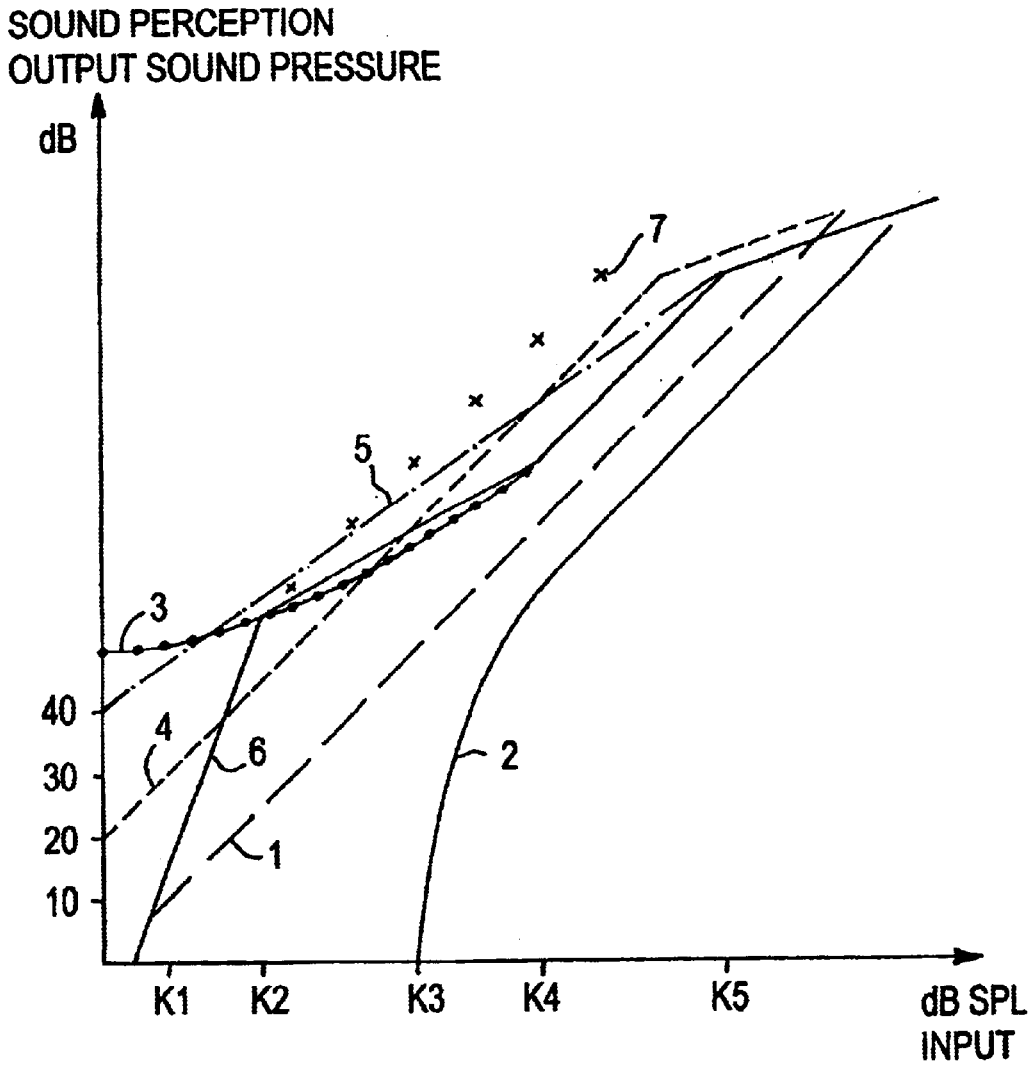
Figure 8:
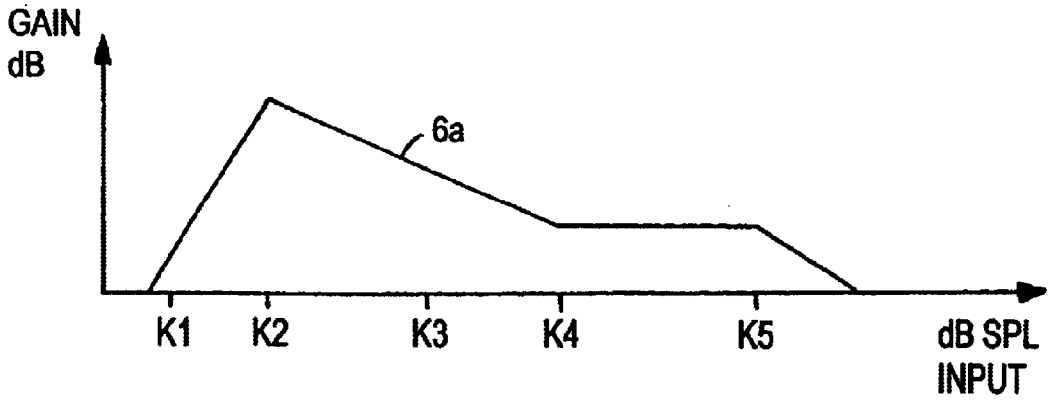
FIG. 8 shows an example of an amplification characteristic illustrating gain as a function of the detected received sound level for use in the method according to the invention.

In particular, the method according to the invention is advantageous when using a transfer function as illustrated by the curve 6 in FIG. 1 with a constant gain in the range of detected sound levels from 70 to 100 dB as illustrated by the curve 6*a* in FIG. 8, whereby pumping effects cannot occur in this range.

Figure 9:
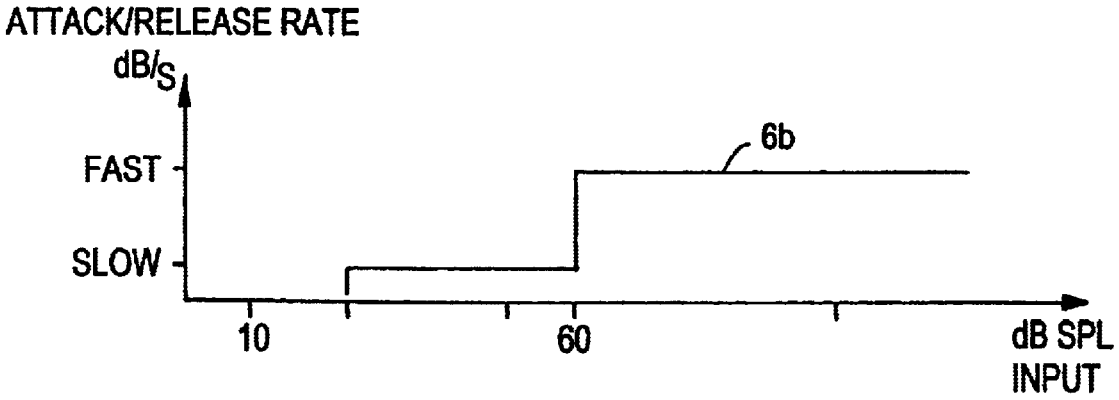
FIG. 9 is a graphic representation of an example of attack-and release times as used in the method according to the invention.

In FIG. 9 an example of the switch-over of attack and release times at an input sound level of 60 dB is illustrated by the curve 6*b* as a change of slope measured in dB/sec for raise and fall-off rate. The curve 6*b* start at a received sound level of 25 dB to indicate that the expansion function below that level can be implemented outside the gain adjustment provided by the invention.

Figure 10:
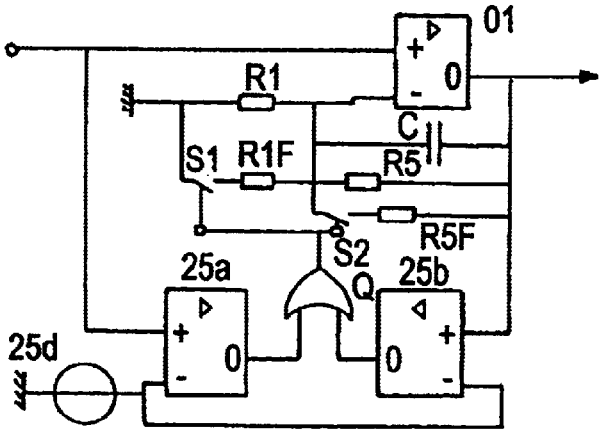
FIG. 10 shows an embodiment of sound detecting means and AGC adjusting means in a hearing aid according to the invention.

FIG. 10 shows an embodiment of sound detecting and AGC gain adjusting means for use in a hearing aid according to the invention. The circuitry receives a preprocessed rectified signal and comprises a conventional leaking integrator device composed of an operational amplifier O1, a capacitor C and resistors R1 and R5 constituting a timing network. In this way, the long durations of the attack and release times will be determined by the time constants:

$ATTACK_{long}$: C*1/(1/R1+1/R5)

$RELEASE:_{long}$ C*R5

The circuitry further comprises a control circuit including comparators 25*a* and 25*b*, an OR gate Q and switches S1 and S2. A reference voltage source 25*d* supplies a reference voltage to one input of each of comparators 25*a* and 25*b*. If the input voltage supplied to the other input of comparator 25*a* or the output voltage supplied to the other input of comparator 25*b* is higher than the reference voltage, the actual comparator will supply an enabling signal to OR gate Q, which in response operates switches S1 and S2 to close, whereby resistors R1 and R5 are connected in parallel with resistors R1*f* and R5*f*, respectively, thus constituting a different timing network, and the short duration of the attack and release times will be determined by the time constants:

$ATTACK_{short}$: C*1/(1/R1+1/R5+1/R1*f*+1/R5*f*)

$RELEASE_{short}$: C*1/(1/R5+1/R5*f*)

To maintain the same ratio of the output voltage from the circuit to the input voltage, the ratio of resistor R1 to resistor R5 must be the same as the ratio of resistor R1*f* to resistor R5*f*, i.e.

R1/R5=R1*f*/R5*f*

By means of the invention, the selection of appropriate attack and release times becomes easier. At low levels, long duration attack and release times can be selected to take account of pumping effects, whereby a relatively long attack time is particular advantageous to avoid pumping and insufficient amplification. At high levels, attack and release times can be selected to take account of a fast dynamic control, whereby a relatively short attack time is particularly advantageous to avoid too early clipping or limitation and to provide for a faster gain decrease, so that sudden actuation of high gain is avoided, whereas a relatively short release time is advantageous for reducing the period during which controls signals remain inactive and actuating clipping or limitation and/or bring the control mode outside the range with insufficient amplification and down to a range with increased gain.

A particular advantage of the method and healing aid of the invention is the possibility of implementing the sound level detecting means in the form of so-called percentile estimators to provide different attack and release times without changing the percentile figure. Such a percentile estimating circuit is known from U.S. Pat. No. 4,204,260, and for use in hearing aids from WO 96/35314. A percentile estimator functions in principle to provide a signal value forming the upper limit for a prescribed percentage of all input signal values, the percentile figure. Thus, a percentile estimator having a percentile figure of 50 supplies the signal value forming the upper limit for the input signal during 50% of the time. Contrary to an average detector, a percentile estimator is not affected by the signal wave shape above or below the percentile figure.

Figure 11:
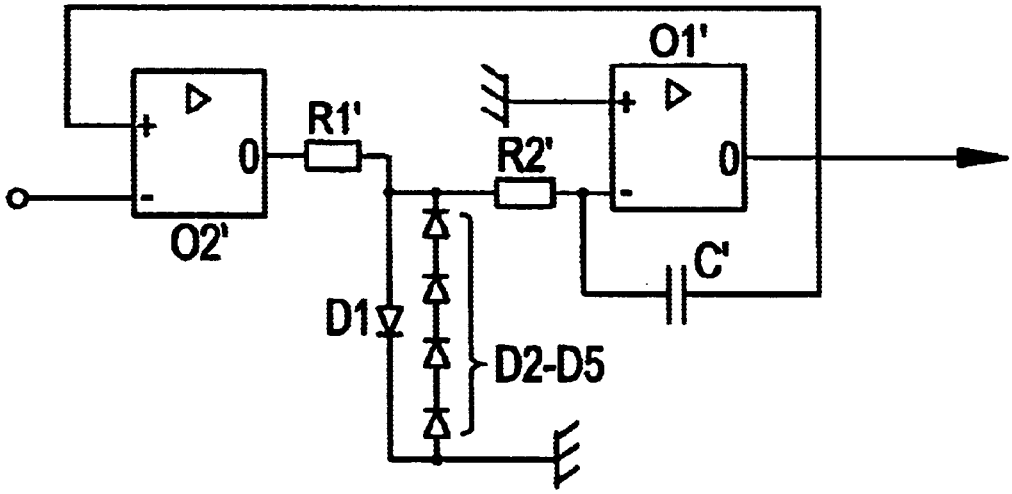
FIG. 11 shows an embodiment of sound level detection means using percentile estimation.

In FIG. 11, an example is shown of circuitry for implementation of a percentile estimator having a percentile figure of 80. The circuit comprises an integrator device including an operational amplifier O1' and a capacitor C' to integrate the signal received from an input circuit comprising a comparator O2', resistors R1' and R2' and diodes D1 to D5. The comparator O2' receives at its non-inverting input the integrator output signal from integrator O1', C', whereas the input signal to be detected is supplied to the inverting input. When this input signal exceeds the value detected by the integrator, the output signal from comparator O2' will shift to low with a negative voltage, and current will flow through the series arrangement of diodes D2 to D5 and resistor R1' to comparator output O. In this way, a negative voltage 4*Ud will appear across the diodes, Ud representing the voltage drop per diode and the same voltage will exist across resistor R2' and, as a result, the integrator O1', C' will be charged with a positive upward integration value u=(4*Ud)/R2'

When the input signal is smaller than the value detected by the integrator, the output signal from comparator O2' will be high with a positive voltage, and the current will flow from output O through resistor R1' and diode D1 resulting in a positive voltage across the diode arrangement corresponding to 1*Ud. The same voltage drop exists across resistor R2', whereby the integrator will be discharged with a negative downward integration value d=(1*Ud)/R2'

In this way, the percentile estimator will adjust itself to a value with upwards integration in one period and downwards integration in four periods, i.e. to the value representing the percentile figure $$p = 100\% * u(u+d) = 100\% * (4 * Ud)/(4 * Ud + 1 * Ud) = 80\%$$

The attack and release times between maximum and minimum excitation will depend on the time involved to adjust from zero voltage at the output O of operational amplifier O1' to maximum output voltage Umax and back to zero voltage, whereby maximum attack and release times will be determined by $ATTACK_{max}$=R2'*C'*Umax/(4*Ud)

$RELEASE_{max}$=R2'*C'*Umax/(1*Ud)

Figure 12:
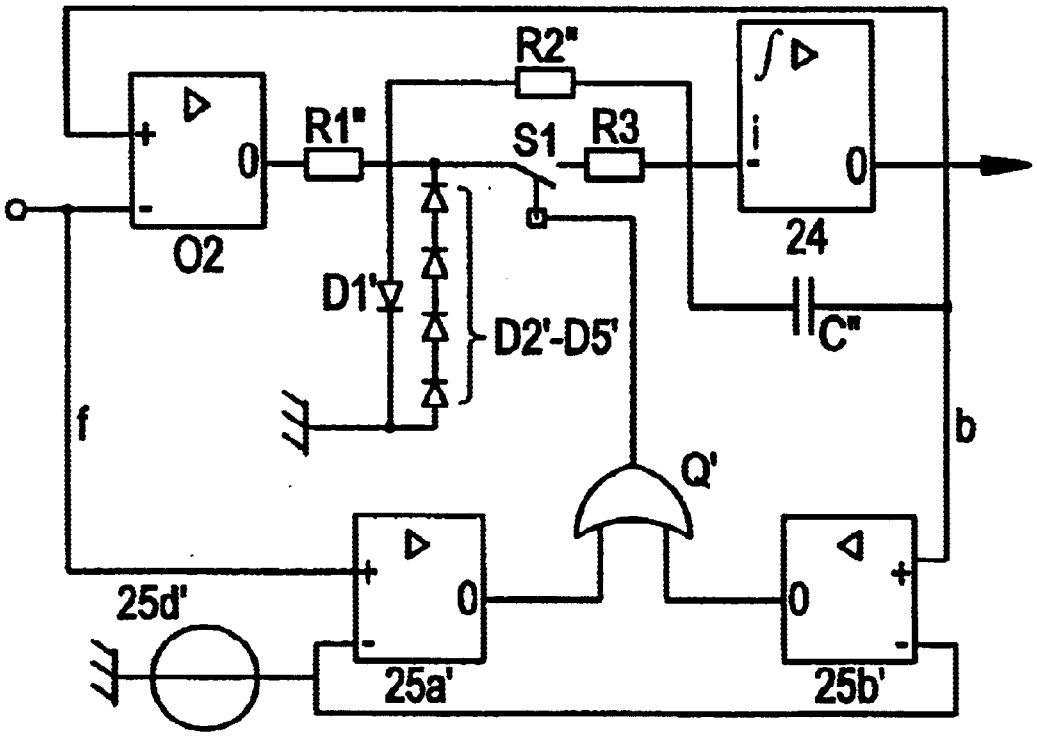
FIG. 12 shows a further embodiment of AGC adjusting means in a hearing aid according to the invention using sound level detection means as illustrated in FIG. 9.

FIG. 12 shows a modification of the percentile estimator circuit in FIG. 11 for generation of attack and release times, which depend on the detected sound level. The circuitry incorporates a control circuit including comparators 25*a*' and 25*b*' together with an OR gate Q' corresponding in principle to the control circuit shown in FIG. 10 with the modification that only a single switch S1 is actuated by OR gate Q'. The percentile estimator part of the circuit corresponds in principle to the percentile estimator circuit in FIG. 11 except for the incorporation of switch S1 in series with resistor R3, in parallel with resistor R2". The attack and release times can thereby be switched to a short duration by closure of the switch S1' upon actuation from OR gate Q'. Thus, short duration attack and release times between maximum and minimum excitation will be determined by $ATTACK_{max,fast}$=(1/(1/R2'+1/R3))*C"*Umax/(4*Ud)

$RELEASE_{max,fast}$=(1/(1/R2'+1/R3))*C"*Umax/(4*Ud)

The invention may also be implemented in other ways, e.g. in the form of a software control programm in a digital hearing aid. The integrator may be implemented as an up and down counting integrator memory. By selection of a 15 bit memory values from 0 up to a maximum count of 32768 may be stored. Using a percentile estimator having a percentile figure of 80 gives the following calculation $$p=100\%*u/(u+d), \text{ and } u=4*d$$

If u is selected to 8000 upward counts per second and d to 2000 downward counts per second for a first timing network to generate long duration attack and release times, the following figures will apply between maximum and minimum excitation $$ATTACK_{\max,slow} = Count_{\max}/u = 32768/8000/\text{sec} = \text{ca. } 4.1 \text{ sec}$$

$$RELEASE_{\max,slow} = Count_{\max}/d = 32768/2000/\text{sec} = \text{ca. } 16.4 \text{ sec}$$

Figure 13:
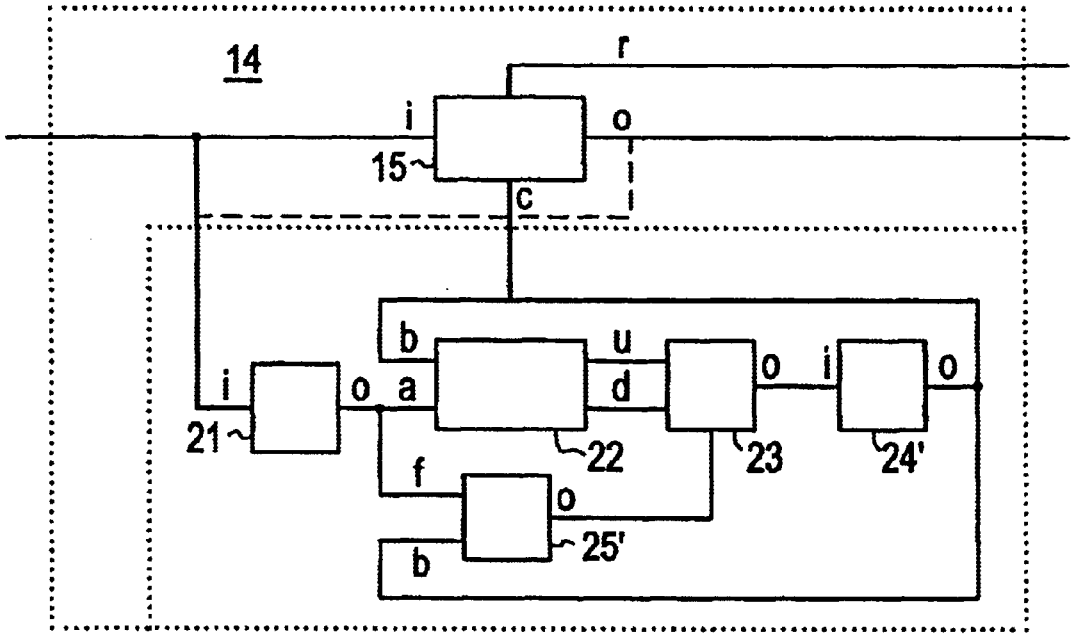
FIG. 13 shows a signal processing channel in a still further embodiment of a hearing aid according to the invention using modified percentile estimator detecting means.

If for the short duration attack and release times u is selected to 400,000 counts per second and d to 100,000 counts per second for a second timing network, the following figures will apply between maximum and minimum excitation $ATTACK_{max,fast}$=32768/400000/sec=ca. 0.082 sec $RELEASE_{max,fast}$=32768/100000/sec=ca. 0.33 sec FIG. 13 shows a signal processing channel 14 in a further embodiment of a hearing aid according to the invention with detection means including a modified percentile estimator circuit. The microphone signal from the input stages is received by a detector 21 connected in a feed-forward arrangement with the adjusting means of the AGC control. In the detector 21 a transformation of the signal for further processing is effected, which may suitable involve rectification into an absolute value signal and conversion into a logarithmic signal to provide an output signal from detector 21 corresponding to a dB scale. However, the particular design of the detector itself is not essential to the operation of the hearing aid, and alternatively other conventional detecting circuits and functions may be used, the only requirement being that the detector supplies, as the actually detected sound level, a signal that can be processed by the subsequent circuitry, and that this output signal is supplied with a time delay which is sufficiently short to allow the following percentile estimator circuit to supply its output signal within the maximum time delay prescribed for the overall circuit, said time delay being e.g. 10 msec.

From the output 21*o* of detector 21 the signal representing the detected sound level is supplied to one input 22*a* of a comparator 22, which via an integrator control circuit 23 supplies a control signal to an integrator 24'. From an output 24*o* of integrator 24' a gain adjustment signal is supplied to a control input 15*c* of the signal processor 15 and a feed-back signal is supplied to the other input 22*b* of comparator 22. This feed-back signal represents prior percentile estimates or the earlier detected estimate, which is actually used to determine the gain. Thus, unlike the detecting and gain adjusting means shown in FIG. 10, where the input signal is supplied directly to the input of the integrator, the sound level signal is processed in comparator 22 and integrator control circuit 23 before being supplied to the integrator 24'.

In comparator 22 the actual input signal supplied to input 22*a* is compared to the earlier percentile estimate fed back to input 22*b*. If the actual sound level signal exceeds the earlier percentile estimate, a control signal is supplied from one output 22*u* of the comparator to the integrator control circuit 23 effecting count-up of the integrator and thereby raising of the earlier percentile estimate. If the actual sound level signal is smaller than the earlier percentile estimate, a control signal is supplied from a second output 22*d* of the comparator 22 via integrator control circuit 23 to the effect of count-down regulation of the integrator 24' and thereby lowering of the earlier percentile estimate. The count-up and count-down regulation of integrator 24' are effected by quantities u and d supplied from the output 23*o* of the integrator control circuit 23 to the input 24'*i* of the integrator 24'. Thereby, the integrator 24' is currently adjusted towards the signal value supplied from the detector as a representation of the actually detected sound level.

In the integrator control circuit 23 the count-up and count-down control signals from comparator 22 are transformed into control quantities u and d, respectively. The control quantity u or d to be actually used is determined by a percentile control circuit 25' having detecting inputs connected with the output 24'*o* of integrator 24' and the output 21*o* of detector 21 through control lines f and b.

By means of this circuitry, the attack time can be adjusted by feed-forward control as a function of the output signal from detector 21, whereas the release time can be adjusted by feed-back control as a function of the feed-back signal from the output 24'*o* of integrator 24'. With respect to the signal processing circuit 15 the overall adjustment circuit functions, however as a feed-forward control, and the release time will always be determined by the input level prior to the AGC circuit.

The adjustment circuit may also have a single detecting input connected with the output 21*o* of detector 21 via control line f. Since the adjustment is effected, in this case, with a feed-forward arrangement it is possible to store a representation of the number of times or the duration of time, through which count-up adjustment has been effected with the short attack time to permit count-down adjustment with a short release time through the same period of time as used for the count-up adjustment. This may be effected by storing the counts with a short attack time in a separate fixed memory, and when the count in this memory is bigger than zero, the release time is set to the short duration, which is used to count-down the fixed memory and the integrator memory with the short release time, until the fixed memory reaches the value zero. Thereby, the short release time will be applied through an interval corresponding to the interval used for the short attack time.

The adjustment circuit may also have a single detecting input connected with the output 24'*o* of integrator 24' via control line b. Since in this case the adjustment is effected with a feed-back arrangement only, there will be a delay in going from long to short attack times, i.e. from slow to fast adjustment. This solution is advantageous to avoid a sudden decrease in gain or output sound level, when short noise pulses occur in normally quiet surroundings.

As shown by a dashed line the input 21*i* of the detector 21 may also be connected to the output of the signal processing circuit 15. Thereby, the overall adjustment circuit will operate in a feed-back arrangement with respect to the signal processing circuit in the same way as illustrated in FIG. 3. The control lines f and b for the detecting inputs of the percentile control circuit 15 may, thereby, be arranged as described above.

Figure 14:
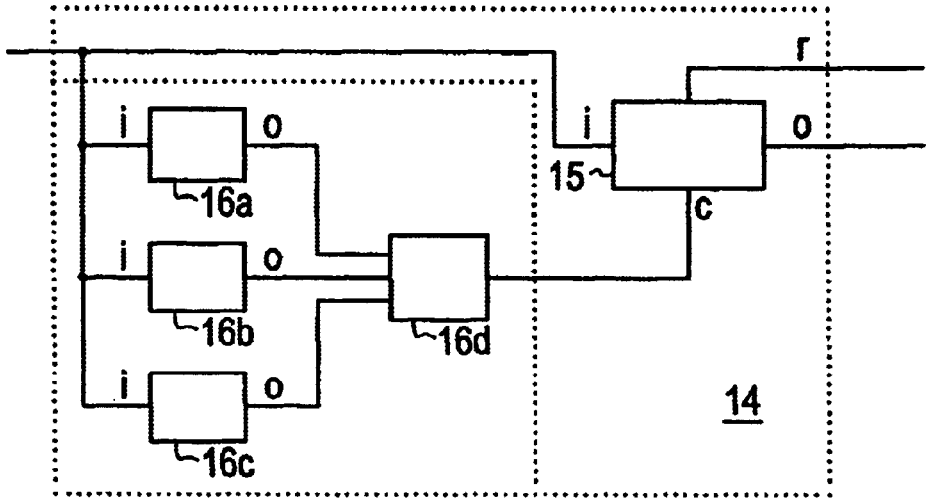
FIG. 14 shows a modification of the embodiment in FIG. 11 using sound level detecting means comprising a plurality of percentile estimators.

As illustrated in FIG. 14 the sound level detecting circuit may also comprise a plurality of percentile estimators 16*a* to 16*c* controlled by a logic control circuit 16*d* selecting the estimator or estimators to be used for gain adjustment in the actual situation as well as the extent to which the gain shall be effected by the output signal from the estimators. The estimators may comprise e.g. a 10% estimator 16*a*, a 50% estimator 16*b* and a 90% estimator 16*c*. If such estimators are made responsible for the adjustment in separate ranges as a function of the detected sound level, the shift or switching between the estimators may suitably be arranged to produce smooth transitions, so that a shift does not produce a sudden change of gain.

Preferably, the shift between different percentile figures is effected by stepwise or continuous adjustment of the values in integrator control circuit 23 and correction of the output value from the integrator control circuit for the change in percentile figure, since with usual signal values the 10% percentile estimator will produce a smaller output signal than the 90% percentile estimator.

This correction may also be performed, however, by changing the transfer function such as the curve 6 in FIG. 1. The estimators may also be of different types. Thus, the estimators 16*a* and 16*b* may be operative in the range above knee point K2 in the transfer function shown by the curve 6 in FIG. 1, so that by detected sound levels below knee point K2 no percentile estimate is produced, and the gain is controlled by an expander circuit acting momentarily in the range below knee point K2. A momentarily acting expander function in this range will not significantly affect the fidelity of the sound reproduction, as the sound level is low, but the momentarily acting expander function may be advantageous for suppression of noise in this range in a smooth way without sudden sound reproduction.

Figure 15:
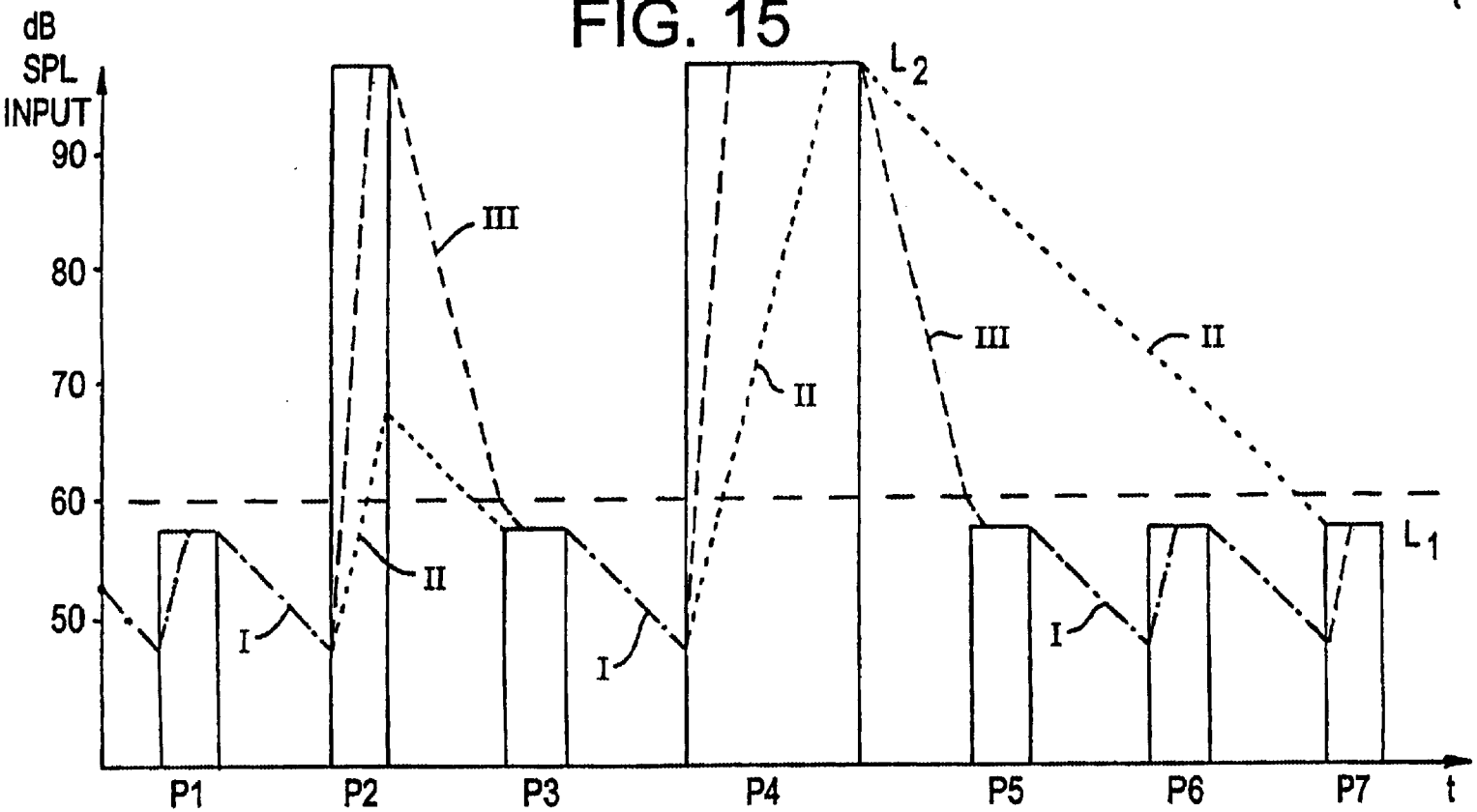

In FIG. 15, a graphic representation of percentile estimates for long and short attack and release times, respectively, is shown for an input signal varying as a function of time t. The representation relates to a feed-forward arrangement of the detecting and gain adjustment means of the invention with respect to the AGC control circuit and with internal attack time adjustment in feed-forward arrangement and release time adjustment in a feed-back arrangement. The representation relates further to a transfer function as illustrated by the curve 6 in FIG. 1 with a switch-over between short and long duration attack and release times at 60 dB as illustrated in FIG. 9 and the ratio of the short duration to the long duration attack and release times is 1:4, this ratio having been selected for reasons of illustration.

The figure shows a number of sound pulses P1 to P7 shifting between a low input signal level L1 below the 60 dB switch-over level and a high input signal level L2. The dash-and-dot line curve I below the 60 dB switch-over level illustrates the time delays resulting from the relatively long duration attack and release times used in this range. For the sound pulses P2 and P4 reaching a peak level significantly above the 60 dB switch-over level the dotted curve II illustrates the effect of time delays caused by relatively long duration attack and release times as used below the 60 dB level, whereas the dashed curve III illustrates the effect of using relatively short duration attack and release times in this range.

Figure 16:
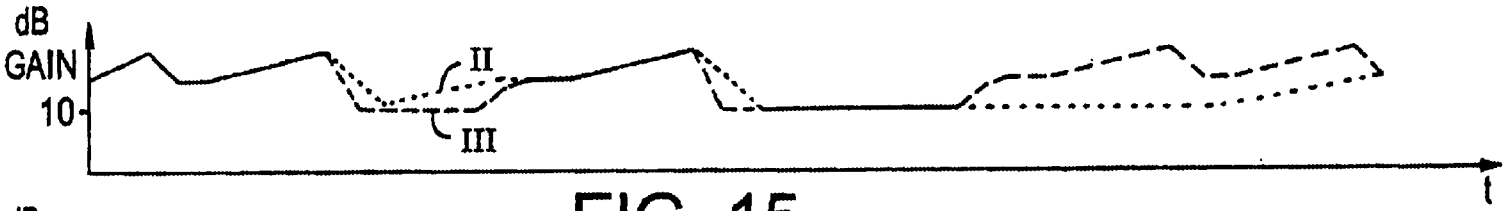
FIGS. 15 and 16 are graphic representations serving to illustrate the effect on percentile estimate and gain, respectively, of using short and long attack and release times in accordance with the method of the invention.

Whereas use of the long duration attack and release times as illustrated by the curve 11 would result in suppression of the low level sound pulses P5 and P6 following the high level pulse P4, use of the short duration attack and release times for high input sound levels will as illustrated by the dashed curve III result in a faster gain adjustment for signal level changes above the switch-over level, as also illustrated in FIG. 16 showing a graphic representation of the gain adjustment as a function of time t for the example shown by sound pulses P1 to P7 in FIG. 15.

As further illustrated by FIG. 16, the maximum gain adjustment with the short duration attack and release times are 5 dB as also illustrated by FIGS. 8 and 9.

Thus, by using short duration attack and release times in the range, in part of which the amplification is mainly constant, a faster adjustment is obtained in this range without noticeable pumping. Pumping effects can be completely removed by limiting the use of the short duration attack and release times to the range, where amplification is mainly constant, said range being in the illustrated example the range above a detected input signal level of 70 dB. By the simultaneous active selection of longer duration attack and release times in the range, where amplification is determined by a dynamic compressor function pumping effects are reduced in this range.

Thus, for a compression characteristic as shown in FIG. 8 with a gain change of 0.5 dB per dB of detected sound level a change of the detected sound level corresponding to 32 dB/sec will result in a maximum attack gain change rate of 16 dB/sec and a maximum release gain change rate of 4 dB/sec by use of a 80% percentile estimator.

In the following example, a hearing aid according to the invention is assumed to have an excitation range of 120 dB for the detected sound pressure, a switch-over level at 60 dB for the change between short and long duration attack and release times, fast and slow release rates corresponding to changes in the detected sound pressure of 300 and 16 dB/sec, respectively, corresponding to short and long $release_{max}$ times of 0.4 and 7.5 sec., respectively, corresponding fast and slow attack rates of 1200 and 64 dB/sec, respectively, corresponding to short and long $attack_{max}$ times of 0.1 and 1.9 sec., respectively, and a transfer function as illustrated by the curve 6 in FIG. 1. For comparison conventional attack and short and long release times of 0.1, 0.4 and 7.5 sec. corresponding to attack and fast and slow release rates of 1200, 300 and 24 dB/sec are used.

After excitation of the detection range up to 120 dB with a short noise pulse caused e.g. by slamming of a door, a gain increase to 5 dB will be reached already after 0.2 seconds followed by an increase of 8 dB/sec, as a result of which amplification is quickly restored without noticeable pumping effect, and maximum gain is reached about 2.4 seconds after the noise pulse. On the other hand, if only a long release time is active in the entire range, 3.8 sec will pass to reach a gain increase of 5 dB and for complete gain restoration 6 seconds will be required.

If the hearing aid in this example with a maximum gain of 30 dB is in a receiving mode corresponding to a detected input sound level of 25 dB and receives a sound impulse of 0.2 sec duration and a level of 60 dB, which will not activate the short attack and release times, the detected sound level will be 38 dB, the gain after the noise pulse will be about 25 dB, and maximum gain will be restored after 0.8 sec. In this case, the listening level will not change materially, and there will be no pumping. On the other hand, when using a conventional hearing aid the detected sound level will be 60 dB and the gain about 15 dB after the sound pulse, and by level controlled shift to the short release time maximum gain will be restored only after 2.2 sec. If, on the other hand a time controlled switch-over between short and long release times is used, the maximum gain of 30 db can be restored from 15 dB in about 0.1 sec, when the short release time is active. This would result, however, in a significant change of the listening level and in a pronounced pumping.

The quantities and values stated above should only be considered examples serving to illustrate the advantages of the invention.

By means of the invention an optimum selection of attack and release times is obtained and a fast acting gain adjustment without noticeable pumping effects is provided, in particular for compensation functions having an upper range with a mainly constant gain, and percentile estimators can be designed with dynamic attack and release times.

The embodiments and solutions described in the foregoing serve as non-limiting examples of implementation of the invention only. These embodiments and examples can easily be adapted by an expert to the healing impairment of an actual user and to an actual hearing aid, e.g. by changing attack and release times and rates as a continuous function of the input signal or provision of various software programmes for controlling dynamic attack and release times. Thus, an audiolog may select and input a selected programme, or the user may freely choose between different functions for dynamic attack and release times or disconnect such functions and select fixed times.

What is claimed is:

1. A method for automatic gain control in a hearing aid comprising at least one input signal transducer, a signal processor including at least one processing channel and an output signal transducer, said method comprising the steps of:

detecting an input signal from said input signal transducer and/or an output signal from said signal processor and adapting, within an operational range of said automatic gain control, said output sound level supplied by said output signal transducer in response to said detected sound level by controlling the gain of said signal processor towards an actual desired value of said output sound level, said gain control being effected at increases and decreases, respectively, of said input sound level by adjusting the gain towards said actual desired value with an attack time and a release time, respectively, whereby said release time is variable in response to changes in said received sound level, wherein said attack and release times are adjusted in response to said detected sound level to a relatively short duration providing fast gain adjustment at high input and/or output sound levels and to a relatively long duration providing slow gain adjustment at low input and/or output sound levels.

2. A method as claimed in claim 1, wherein each of said attack and release times is switchable between distinct values corresponding to said short and long duration, respectively.

3. A method as claimed in claim 1, wherein each of said attack and release times is stepwise or continuously variable in dependence on said input sound level.

4. A method as claimed in claim 2, wherein said detection is effected by comparison of said input and/or output signals with a reference level to provide a control signal for the adjustment of said attack and release times.

5. A method as claimed in claim 4, wherein the adjustment of said attack and release times is effected by means of an integrator circuit to which said control signal is supplied to effect a switching operation between circuit configurations of said integrator circuit providing said distinct values of said attack and recovery times.

6. A method as claimed in any of claim 2, wherein the adjustment of said attack and recovery times is effected by changing percentile time delays in at least one percentile estimator circuit.

7. A method as claimed in claim 6, wherein said percentile time delays are changed to provide the same ratio between said short and long duration for said attack and said release times without changing a percentile figure of said percentile estimator.

8. A method as claimed in claim 6, wherein said percentile time delays are changed to provide a varying ratio between ;aid short and long duration for said attack and said release times in connection with changing a percentile figure of said percentile estimator.

9. A method as claimed in any of claim 1, wherein an input signal from the input transducer is detected, and the adjustment of said attack and release times is effected by feed-forward control with respect to said automatic gain control and/or said signal processor.

10. A method as claimed in claim 1, wherein an output signal from the signal processor is detected, and the adjustment of said attack and release times is effected by feed-back control with respect to said automatic gain control and/or said signal processor.

11. A method as claimed in claim 1, wherein the adjustment of said attack and release times is effected by feed-forward and feed-back control, respectively, with respect to said automatic gain control and/or said signal processor.

12. A method as claimed in claim 1 for use in a hearing aid comprising a digital signal processor, wherein the adjustment of said attack and release times is effected by digital calculation.

13. A method as claimed in claim 1 for use in a hearing aid comprising a signal processor having multiple processing channels, wherein the adjustment of said attack and release times is effected individually in each of said processing channels.

14. A method as claimed in claim 1 for use in a hearing aid having an expander or compressor gain characteristic at low input sound levels up to a predetermined knee point level and a substantially constant gain or a compression ratio at sound levels above said knee point level, wherein the adjustment of said attack and release times to said relatively short-duration is made operative for sound levels above said knee point level only.

15. A hearing aid comprising at least one input signal transducer, a signal processor including at least one processing channel with associated gain control means and an output signal transducer, said hearing aid further comprising detecting means for detecting an input signal from said input signal transducer and/or an output signal from said signal processor and controlling said automatic gain control means in response to said detected sound level to adapt, within an operational range of said automatic gain control, the gain of said signal processor towards an actual desired value of said output sound level, said automatic gain control means including adjusting means to effect said gain control, at increases and decreases, respectively, of said input sound level, by adjustment of the gain towards said actual desired value with an attack time and a release time, respectively, where said release time is variable in response to changes in said input signal level, and wherein said adjusting means is connected to said detecting means to receive a control signal therefrom to adjust said attack and release times in response to said detected sound level to a relatively short duration providing fast gain adjustment at high input and/or output sound levels and to a relatively long duration providing slow gain adjustment at low input and/or output sound levels.

16. A hearing aid as claimed in claim 15, characterized in that said detecting means comprises two comparators to receive an input signal corresponding to said input sound level and an output signal corresponding to said output sound level, respectively, at one input, another input of both comparators being connected to a reference signal source to receive a reference signal level therefrom, common gate control means being connected with the outputs of said comparators and having an output to supply a first control signal for said adjustment means, when both of said input or output signals is below said reference signal level, and provide a second control signal for said adjustment means, when any of said input or output signals is above said reference signal level.

17. A hearing-aid as claimed in claim 16, wherein said adjusting means comprises an integrator circuit including two timing networks to provide said attack time and said release time, respectively, and contact means connected to said gate control means to receive said first and second control signals therefrom to switch each of said networks between first and second circuit configurations, respectively, to provide a distinct value for said relatively short duration or a distinct value for said relatively long duration, respectively, of said attack and release times.

18. A hearing aid as claimed in claim 16, wherein said adjustment means comprises a percentile estimator including a comparator and an integrator circuit connected with an output of the comparator, an output of said integrator circuit being connected with a first input of said comparator, a second input of which receives an input signal corresponding to said input sound level, the output of said comparator being connected to integrator control means-providing a first or second control voltage for said integrator circuit in response to an output signal from said comparator, a timing network connected with said control means being switchable between first and second configurations by switching means controlled by said gate control means to provide maximum values of said attack and release times for said long duration and said short duration, respectively.

19. A hearing aid as claimed in claim 15, wherein said adjustment means of the automatic gain control means comprises a percentile estimator including a comparator having a first input connected with said detecting means and a second input as well as count-up-and count-down outputs, an integrator circuit having an input connected to an output of an integrator-control circuit receiving said count-up and count-down output signals from said comparator (22), said integrator control circuit being controlled by a percentile control circuit having a first input connected with said detecting means, whereas said second input of said comparator and a second input of said percentile control circuit are connected with an output of said integrator circuit, which is further connected to said signal processor for supplying a gain control signal thereto.

20. A hearing aid as claimed in claim 19, wherein said detecting means is connected with said input signal transducer for feed-forward gain control of said signal processor.

21. A hearing aid as claimed in claim 19, wherein said detecting means is connected with said the output of said signal processor for feed-back gain control of said signal processor.

22. A hearing aid as claimed in any of claim 19, wherein said signal processor is a digital signal processor incorporating said percentile estimator.

23. A hearing aid as claimed in any of claim 15, wherein said signal processor includes multiple processing channels with individual automatic gain control means, detecting means and gain control adjusting means.

24. A hearing aid as claimed in any of claim 15, wherein said signal processor has an expander or compressor characteristic: for low input sound levels up to a predetermined knee point and a substantially constant gain or a compression ratio for sound levels above said knee point, wherein said gain control adjusting means includes means to enable adjustment of said attack and release times to said relatively short duration for sound levels above said knee point only.

* * * * *